US006164556A

United States Patent [19]

Dupre et al.

[11] Patent Number: 6,164,556

[45] **Date of Patent: *Dec. 26, 2000**

[54] PORTABLE SNOW MAKING SYSTEM FOR HOME USE

[76] Inventors: Herman K. Dupre, c/o Seven Springs, Champion, Pa. 15622; Charles N. Santry, 409 Heath St., Chestnut Hill, Mass. 02167

[ * ] Notice: This patent is subject to a terminal disclaimer.

[21] Appl. No.: 09/489,899

[22] Filed: Jan. 24, 2000

Related U.S. Application Data

[63] Continuation-in-part of application No. 09/283,844, Apr. 1, 1999, Pat. No. 6,039,265.

[51] Int. Cl.[7] ..... F25C 3/04

[52] U.S. Cl. ..... 239/14.2; 239/280; 239/280.5; 239/281

[58] Field of Search ..... 239/2.2, 14.2, 239/280, 280.5, 281

[56] References Cited

U.S. PATENT DOCUMENTS

| | | | |
|---|---|---|---|
| 3,761,020 | 9/1973 | Tropeano et al. | 239/14.2 X |
| 4,004,732 | 1/1977 | Hanson | 239/14.2 X |
| 5,044,151 | 9/1991 | Dupre | 239/2.2 |
| 5,810,251 | 9/1998 | McKinney | 239/2.2 |
| 5,836,513 | 11/1998 | Smith et al. | 239/14.2 X |
| 5,884,841 | 3/1999 | Ratnik et al. | 239/2.2 |
| 5,934,556 | 8/1999 | Charriau et al. | 239/14.2 |
| 6,039,265 | 3/2000 | Dupre et al. | 230/14.2 |

*Primary Examiner*—Andres Kashnikow
*Assistant Examiner*—Robin O. Evans
*Attorney, Agent, or Firm*—Carothers & Carothers

[57] ABSTRACT

A portable snow making system for home use which is mounted on a hand towable vehicle for easy portability. An elongated telescoping support pole is detachably supported from the base of the vehicle and a snow making gun is mounted on the upper end of this support pole to provide a snow making tower. Snow making nozzles are provided in the gun for ejecting air and water under pressure into the ambient subfreezing atmosphere for manufacturing snow. A high pressure water pump, connected to a common house water spigot, and an air compressor are also mounted on the vehicle to provide sources of water and air under pressure to the snow gun.

7 Claims, 6 Drawing Sheets

PORTABLE SNOW MAKING SYSTEM FOR HOME USE

CROSS REFERENCE

This application is a continuation-in-part of U.S. application Ser. No. 09/283,844, filed on Apr. 1, 1999, now U.S. Pat. No. 6,039,265.

BACKGROUND OF THE INVENTION

The present invention pertains to a snow making system for manufacturing snow in subfreezing ambient conditions for snow sledding, skiing or boarding. More particularly, the present invention pertains to such a snow making system which is portable and adapted for home use.

Snow making equipment has been available for many years for the ski resort industry. However, equipment available for manufacturing snow in subfreezing conditions for ski resorts is far too expensive for the average home owner to utilize such equipment at home. In addition, while some snow making equipment used in the industry is portable in nature, it is not sufficiently portable for home use.

It is principal object of the present invention to provide a portable snow making system for home use which is inexpensive to manufacture and easy to use.

SUMMARY OF THE INVENTION

The portable snow making system for home use of the present invention includes a portable snow making tower which has an elongated support pole that is supported from a base and is further provided with a snow making gun mounted on the upper end of the pole. Snow making nozzles are provided in the gun for ejecting or discharging air and water under pressure into ambient atmosphere for making snow in subfreezing conditions.

Air and water inlets are provided on the gun for respective connection to sources of air and water under pressure from an air compressor and water pump, which are mounted on a hand towable vehicle such as a wagon, wheelbarrow structure or sled. Respective high pressure hoses connect the snow gun to the sources of air and water under pressure on the portable vehicle.

A low pressure hose is connected to the water pump for connecting the water pump to a common supply of water. For example, such a supply might be a common household water spigot or an adjacent outdoor water pond.

The base of the support pole which support s the snow gun at the top thereof is also supported on the towable vehicle and the entire system moves easily as a hand towable unit. Extra storage may also be provided on the towable vehicle for storing hoses and electrical lines.

The high pressure water pump and air compressor will have a combined horsepower rating of less than 12 horsepower thereby making the system extremely portable and readily towable on the towable vehicle. This condition also permits the system to be readily used on available electric supply power normally found in a home. For example, the air pump and water pump may be electric pumps which are operated from a common household 110 volt electric outlet. Of course light weight gasoline operated water pump and air compressor combinations may also be utilized.

The pole which supports the snow gun at the upper end thereof is detachably supported on the towable vehicle and is also preferably telescopically collapsible and extendable so that the height of the snow gun above ground level may be readily varied for storage purposes or for selective positioning of the gun to provide proper placement of manufactured snow.

If the water supply for the high pressure water pump is provided from a common household spigot, it may be found that the water is too warm for manufacturing snow. In this event, it is also preferable to provide a heat exchanger which circulates the water therethrough in the ambient atmospheric cold subfreezing conditions to cool the water prior to the water being delivered to the water pump. In addition, a cooling pool filled with water may be positioned adjacent the towable vehicle for submerging portions of the hoses which feed the water pump and the air compressor and water hoses which feed the snow gun at the top of the support pole for precooling the fluids passing through the hoses.

The snow gun itself which is mounted to the top of the support pole is provided with a housing that has a water inlet for access of water under pressure to the interior of the housing and one or more water nozzles for spraying water under pressure from the interior of the housing to ambient atmosphere. A tube having opposite ends and passing through this housing for exposure of exterior surfaces thereof to the interior of the housing to warm air passing through the tube is provided with an air inlet at one end thereof for ingress into the tube of air under pressure and an air nozzle at the other end of the tube for discharge of air under pressure into ambient atmosphere. These nozzles are positioned for externally intermixing water and air discharges therefrom for manufacturing snow in subfreezing ambient atmospheric conditions in accordance with known teachings. The invention is however applicable to either internal or external mixing of air and water under pressure.

The water inlet to the snow gun housing is positioned for directing the flow of water under pressure within the housing toward the end of the air tube which contains the air discharge nozzle for circulating water adjacent the air nozzle in order to prevent the air nozzle from freezing due to freezing of moisture contained within the pressurized air. To further assist this condition, the air nozzle is also preferably recessed into the gun housing.

The support pole for the snow gun extends upward from its support base at an approximate angle of 60°. The water nozzle is angled upwardly at an approximate angle of 45° relative to the support base, and the air nozzle is angled such that it is at an approximate angle of 45° relative to the water nozzle. This configuration provides maximum efficiency for intermixing of the air and water and atomization of the sprayed water to provide maximum efficiency and maximum throw of the manufactured snow. In addition, this configuration further positions the nozzles such that the resulting thrust created by the ejection of air and water under pressure through the nozzles helps to maintain the support pole in an upright position and directs the major portion of the resultant thrust downwardly through the pole in order to subject the support pole to minimum torsional stresses.

The water inlet for the snow gun housing is positioned at a bottom point on the housing whereby all water will drain from the housing through this water inlet when the system is not in use.

The elongated support pole is preferably hollow and contains therein at least one of high pressure hoses leading to the top of the pole to supply the snow gun. In addition, the elongated supported pole is also detachable at its lower end from the base on the towable vehicle so that the pole may be removed for storage, for placement and use adjacent the towable vehicle, or other purposes. The pole is keyed to the base for preventing relative rotation between the pole and the base.

A preferred configuration for the towable vehicle is accomplished by utilizing the air tank provided for the air compressor to serve as a vehicle body for the towable vehicle itself. Handles may be secured to one end of the air tank in this configuration for moving the towable vehicle in wheelbarrow fashion on vehicle wheels which are secured to the other end of the tank. The wheels of course may be substituted with skids or skis.

A valve mechanism is connected between the air high pressure hose and the water high pressure hose so that the valve may be selectively manipulated in order to purge all water from the water high pressure hose, the water pump and the snow gun with compressed air when preparing to store the system in order to prevent freeze-up in the water lines.

Another variation of the snow gun provided at the top of the elongated pole or tower is comprised of a housing having two spaced air nozzles connected to the air inlet for discharging air under pressure into ambient atmosphere. A first water nozzle is positioned in the same housing and positioned centrally between these air nozzles and connected to the water inlet for the snow gun housing for discharging water under pressure into ambient atmosphere and also into the air discharge streams for atomizing the discharged water to make snow in subfreezing conditions. This external mix of air and water thereby creates an atomized plume of water for manufacturing snow in subfreezing conditions.

One or more water nozzles also may be provided in the snow gun housing and are connected to the water inlet for the housing and are further positioned for discharging additional water under pressure into the ambient atmosphere for combining with the aforementioned plume of atomized water.

BRIEF DESCRIPTION OF THE DRAWINGS

Other objects and advantages of the present invention appear hereinafter in the following description and claims. The accompanying drawings show, for the purpose of exemplification, without limiting the invention or claims thereto, certain practical embodiments of the present invention wherein:

DETAILED DESCRIPTION OF THE PREFERRED EMBODIMENTS

Figure 1:
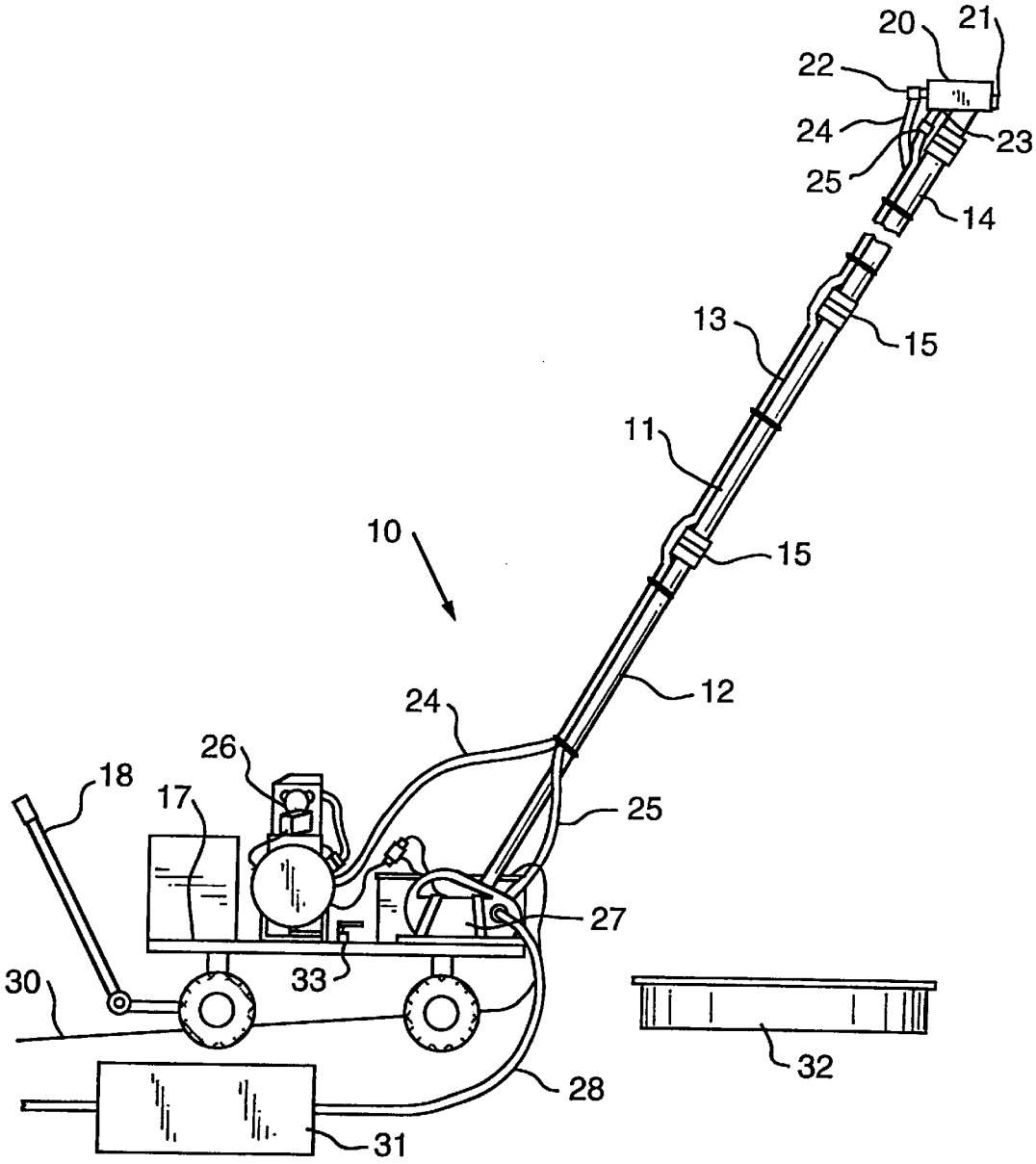
FIG. 1 is a schematic drawing illustrating the portable snow making system for home use of the present invention shown in side elevation.
Figure 2:
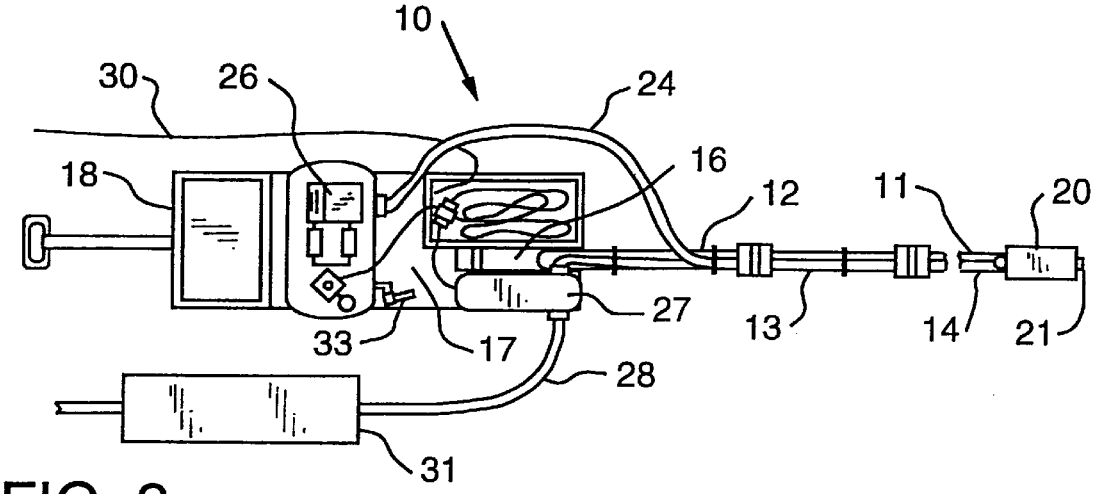
FIG. 2 is a plan or top view of the portable snow making system shown in FIG. 1.

Referring to FIGS. 1 and 2, the portable snow making system 10 includes a portable snow making tower 11 which is an elongated support pole that is telescopically collapsible and extendable in three segments 12, 13 and 14.

The support pole 11 thus may be telescopically fully extended or adjusted to any intermediate position and there retained by tightening stop nuts 15.

Elongated support pole 11 is detachably supported from base 16 which is in turn securely mounted to the base 17 of wagon 18.

A snow making gun 20 is mounted on the upper end of support pole 11.

Figure 3:
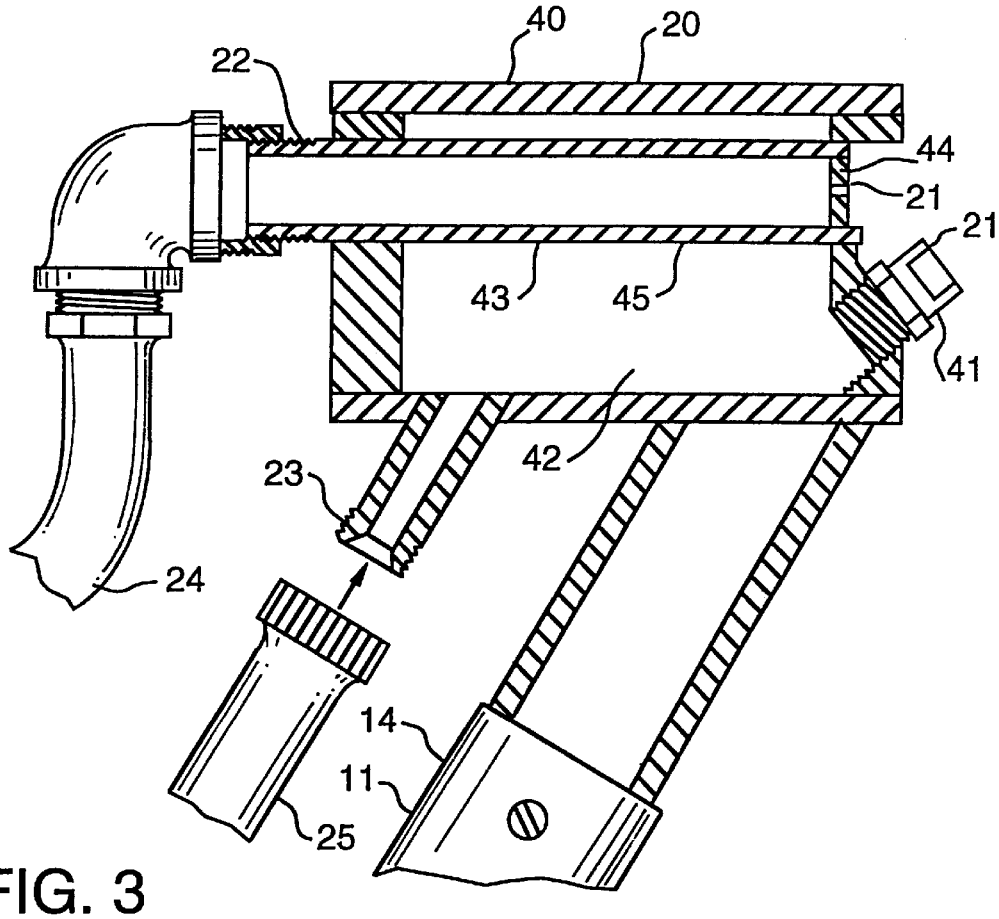
FIG. 3 is an enlarged view in partial vertical mid cross section illustrating the internal workings of the snow making gun mounted on top of the support pole for the portable snow making system for home use shown in FIGS. 1 and 2.

As is best illustrated in FIG. 3, snow making nozzles 21 are provided in gun 20 for ejecting air and water under pressure into ambient atmosphere for making snow in subfreezing conditions. While the system illustrated in these figures is an external mixing system wherein the air and water under pressure are mixed externally of the gun, the principals of the present invention are also applicable to internal mixing guns wherein the air and water under pressure are mixed internally before being ejected into the ambient atmosphere.

Air and water inlets 22 and 23 on gun 20 are provided for respective connection through high pressure hoses 24 and 25 to sources 26 and 27 of air and water under pressure which are an electrically operated water pump and air compressor. The electric pump and compressor could be substituted with gasoline operated versions.

Air compressor 26 and high pressure water pump 27 are securely mounted to the base 17 of hand towable vehicle or wagon 18.

A common garden hose 28 connects high pressure water pump 27 to a common water supply such as an adjacent outdoor pond or to a common water spigot in the home for supplying water to water pump 27.

The combined horse power rating of the water pump 27 and the air compressor 26 is less than 12 horsepower thereby providing a light weight high pressure source for air and water which may be readily operated from a common household 110 volt electrical outlet normally found in the home. The electricity from the source is supplied to the air compressor 26 and the water pump 27 through the electrical line 30.

As previously explained, support pole 11 is not only telescopically collapsible and extendible, but may be completely detached from the towable vehicle 18 at the base 16. This permits the support pole 11 to be fully extended to normally a full extended position whereby gun 20 is 16 feet off of the ground or to any lesser or intermediate position for assisting in positioning the desired placement of manufactured snow. The support pole 11 also may be fully collapsed so that the entire unit may be readily hand pulled into a garage for storing.

Telescopically collapsible support pole 11 together with its snow making gun 20 mounted at the upper end may be entirely substituted with a conventional support pole 11 which is a non-extendable or collapsible pipe support for conveying air and water therethrough to the upper end thereof to nozzles 21 as has already been described in the prior art for many different type of pipe snow making towers which either internally mix or externally mix air and water under pressure.

If hose 28 is connected up to a common water spigot, the water therefrom may be too warm for manufacturing snow and therefore a heat exchanger 31 is provided such that the water passing through hose 28 passes first through heat exchanger 31, which is positioned in the ambient freezing atmosphere in order to precool the water before it enters high pressure water pump 27.

Heat exchanger 31 may be in the form of metallic baffled heat exchanger or it may be simply in the form of additional extensions of hose 28 in order to provide supplemental cooling.

In addition, a cooling pool 32 filled with water can also be positioned adjacent the towable vehicle 18 for submerging portions of selected ones of the hoses 22, 23 and/or 28 therein for precooling of fluids passing through the hoses for more efficiently manufacturing snow.

The bottom of the air tank for air compressor 26 is also provided with a water drain valve 33 for periodically draining water from condensation which builds up in the tank.

Turning specifically to FIG. 3, snow gun 20 is provided with a housing 40 that has a water inlet 23 as previously explained in a water nozzle 41 for spraying water under pressure from the interior 42 of housing 40 to ambient atmosphere.

Tube 43 having inlet 22, passes through housing 40 for exposure of exterior surfaces 45 thereof to the interior 42 of housing 40 in order to jacket the tube 43 with the warmer water to thereby prevent freeze-up of the moisture within the air tube 43.

An air nozzle 44 is provided at end of tube 43 for discharge of air under pressure into the ambient atmosphere. The air nozzle 44 and the water nozzle 41 are positioned relative to each other for externally intermixing water and air discharges therefrom for manufacturing snow in subfreezing ambient conditions as is known in the prior art. A small wire may be used to clear debris which might plug air nozzle 44.

The water inlet 23 of housing 40 is positioned at a bottom point on housing 40 so that all water will drain from housing 40 through water inlet 23 when the system is off. Additionally, inlet 23 is also positioned whereby the discharge therefrom into the interior 42 of housing 40 is positioned to fully and more efficiently circulate water about the outside 45 of air tube 43 and to further direct the warmer water to the air nozzle 44.

Air nozzle 44 is further recessed into housing 40 as illustrated to provide maximum warming effect from the water blowing within the interior 42 of housing 40 in order to prevent freeze up of air nozzle 44.

The support pole 11 generally extends upward from its support base at an approximate angle of 60° to base 17 and the water nozzle 41 is angled upwardly at approximately an angle of 45° relative to the base 17 of towable vehicle 18.

In addition, air nozzle 44 is angled at an approximate angle of 45° relative to water nozzle 41 thereby providing maximum atomization of the sprayed water from nozzle 41 and maximum efficiency of the snow manufacturing process. In addition, this total arrangement also helps to support the support pole 11 in an upright position and direct the maximum resultant thrusts from the nozzles 44 and 41 downwardly through support pole 11 thereby providing minimum torsional stress against the support pole 11.

Figure 4:
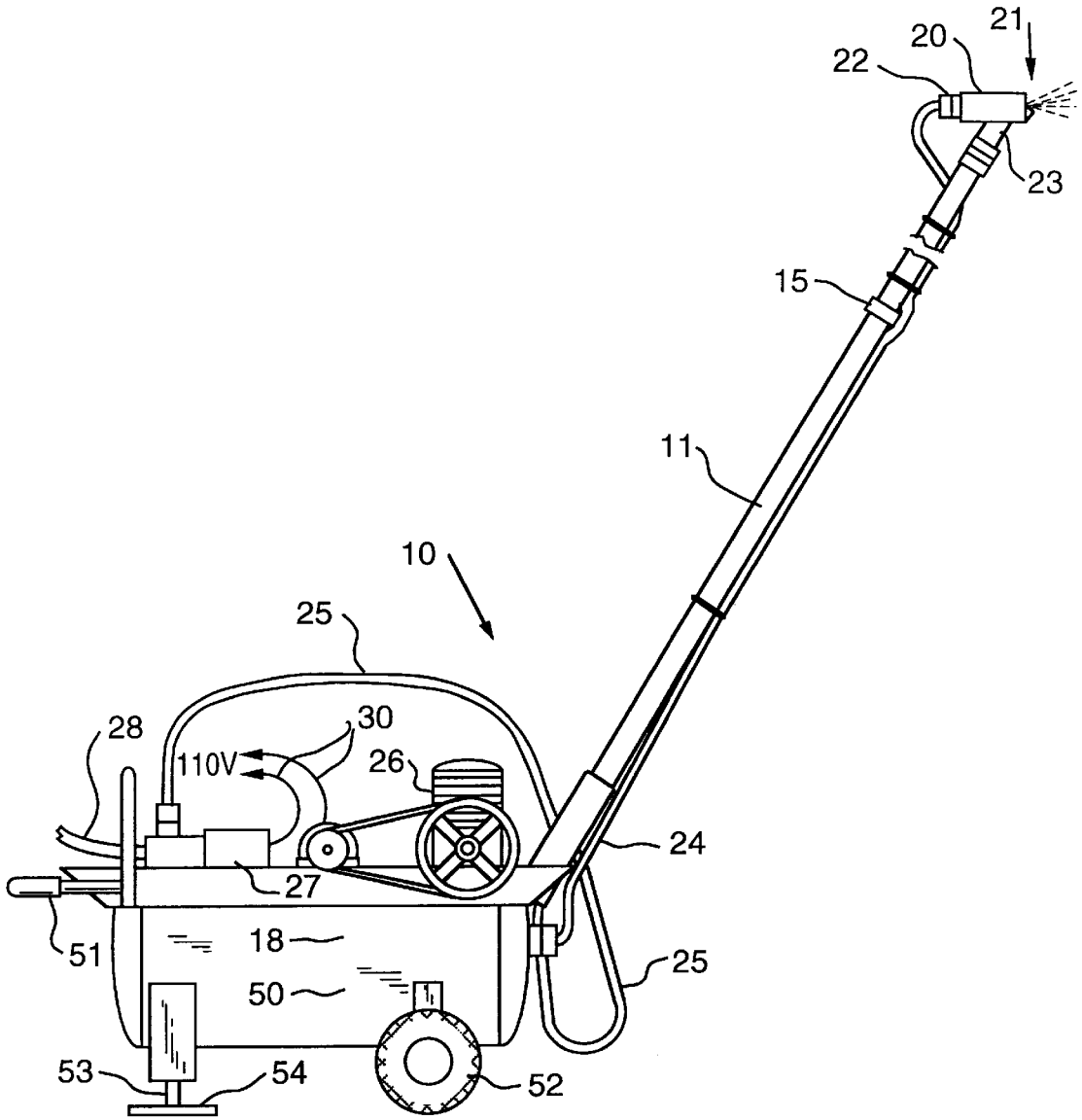
FIG. 4 is a schematic drawing illustrating another embodiment of the portable snow making system for home use of the present invention shown in side elevation.
Figure 5:
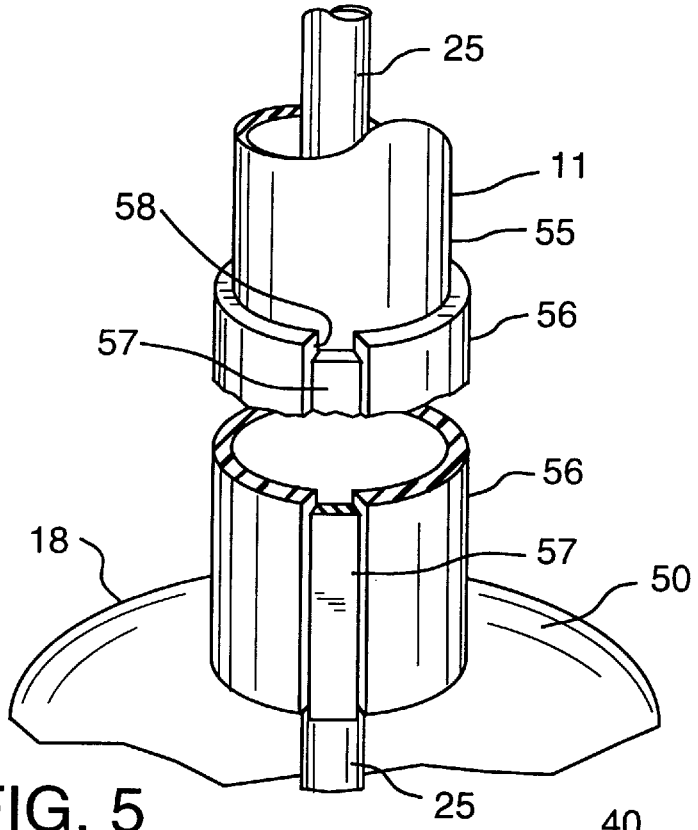
FIG. 5 is an enlarged view illustrating the connection of the lower end of the elongated support pole to the support base for the portable snow making system of FIG. 4.
Figure 6:
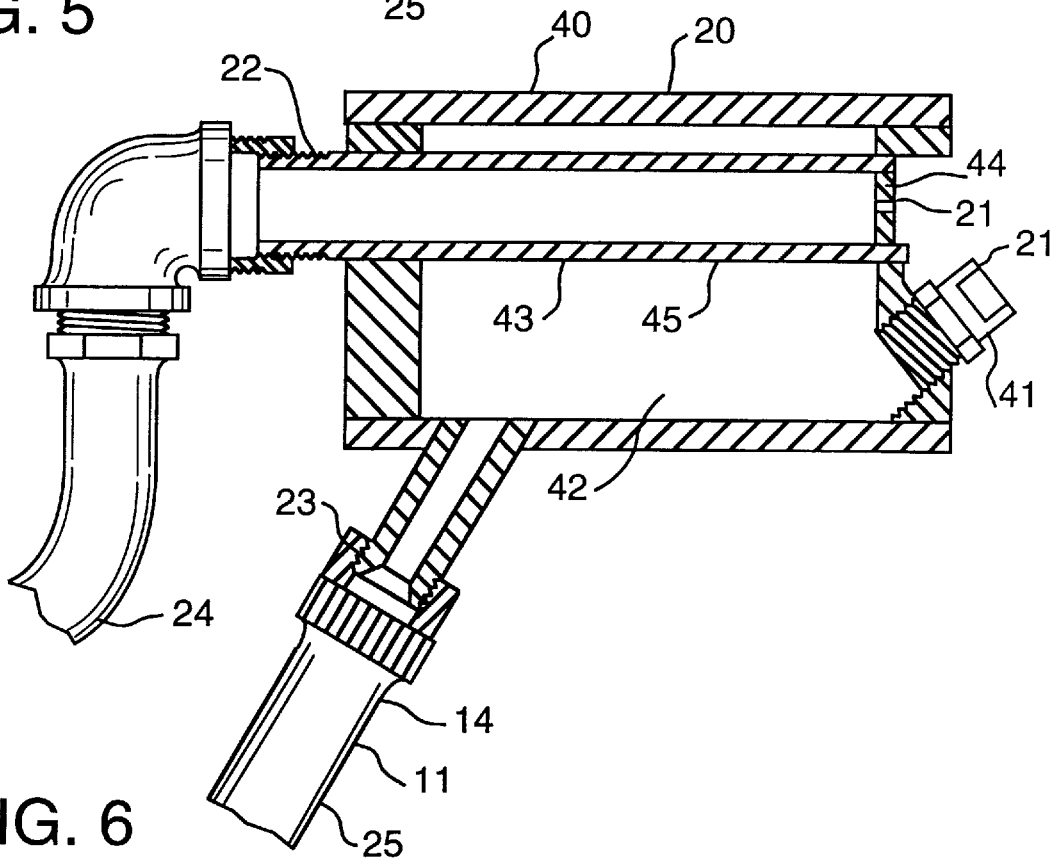
FIG. 6 is an enlarged view in partial vertical mid cross section illustrating the snow making gun used in the portable snow making system of FIG. 4.

Referring to FIGS. 4 through 6, identical or similar elements are indicated with the same reference numerals.

One of the primary differences between the embodiment shown in FIG. 4 from that shown in FIG. 1 is that the embodiment of FIG. 4 utilizes the air storage tank or air tank 50 of the air compressor 26 to serve as the vehicle body for the towable vehicle 18. Wheelbarrow type handles 51 are secured to one end of air tank 50 for moving the towable vehicle in wheelbarrow fashion on wheels 52 secured to the opposite end of tank 50. This embodiment takes advantage of compressors readily available on the market which utilize the compressor tank as a wheeled vehicle body for portability.

Opposite wheels 52 and below handles 51, rear legs 53 are secured to air tank 50. Legs 53 are provided with bottom plates 54 which act as feet for supporting the rear portion of the towable vehicle 18 on a snow surface. These feet plates 54 may be provided with through perforations so that spikes may be driven down through these perforations to secure feet 54 firmly to an ice covered slope to prevent the unit 10 from sliding out of position.

Another feature of the embodiment illustrated in FIG. 4 is that the elongated support pole 11 in this instance is hollow and the high pressure water hose 25 is contained within telescopic elongated support pole 11. Actually, as can be best seen in FIG. 6, the upper telescopic section 14 of the elongated support pole 11 provides the last portion or segment of high pressure water hose 25 itself for direct connection to snow gun 20.

Also, as may be best seen in FIG. 5, elongated support pole 11 is detachable at its lower end 55 from base 56 which in turn is directly secured to towable vehicle 18 or tank 50. This lower end 55 of pole 11 is keyed as indicated at 57 to base 56 for preventing relative rotation therebetween. In other words, base 56 is provided with a longitudinal frontal slot 58 therein for receiving vertical elongated key 57 that protrudes from the bottom of lower end 55 of pole 11 such that it is received in slot 58 to prevent relative rotation between base 56 and pole 11.

Pole 11 may thus be quickly removed from its base 56 for easy storage or for other applications or uses of the apparatus 10. For example, the snow making tower in the form of pole 11 and snow making gun 20 may be positioned adjacent to vehicle 18 on a separate support for snow making.

With particular reference again to FIG. 6, it should be noted that the snow making gun 20 is identical to the structure shown in FIG. 3, with the exception that in this embodiment only a single support arm is required to support the entire head of snow gun 20 on top of support pole 11 since the water supply inlet 23 and the connection thereto from support pole 11 are one in the same. This of course eliminates additional expense in manufacturing costs that are incurred with the structure shown in FIG. 3.

Also in the structure illustrated in FIG. 4, it should be noted that the air line 24 is run up the underside of the pole 11. This arrangement causes water running over and down support pole 11 to engage the underlying high pressure air hose 24 and thereby also assist in cooling the air passing through air line 24 before it reaches nozzles 21.

Figure 7:
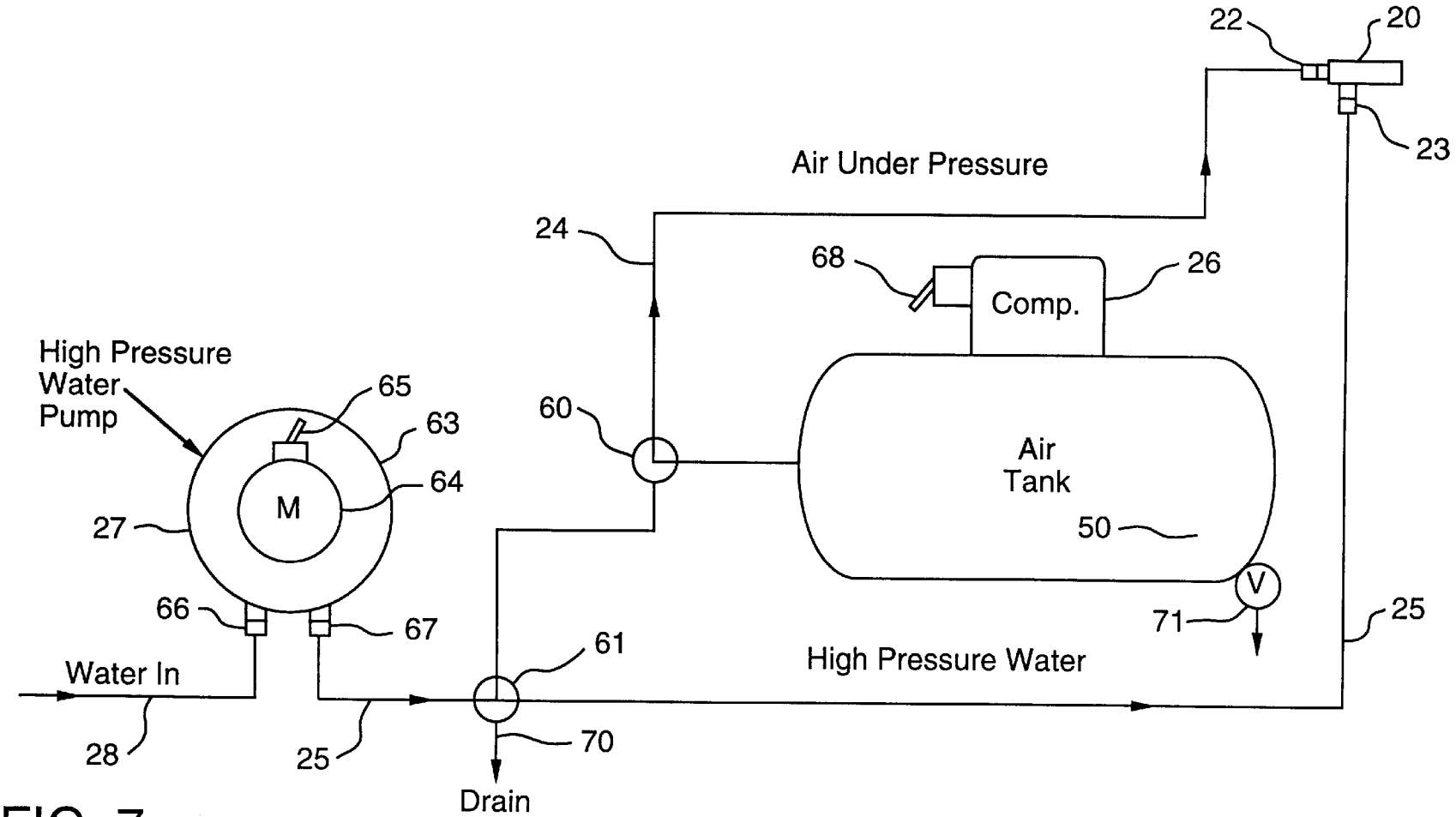
FIG. 7 is a schematic diagram illustrating the air and water plumbing configuration and hookup for the portable snow making system as shown in FIGS. 1 and 6.

Referring next the schematic diagram shown in FIG. 7, a valve mechanism is provided in the form of two valves 60 and 61 and this valve mechanism is connected between air high pressure hose 24 and water high pressure hose 25 for selective manipulation of the valves 60 and/or 61 to purge water from high pressure hose 25 with compressed air from high pressure line 24 when the unit is being shut down, in order to drain all water therefrom to prevent freeze-up.

In FIG. 7, high pressure water pump 27 is illustrated in more detail to include a pump housing 63, housing a pump which is driven by electric motor 64. Electric motor 64 in turn may be switched on and off via electric switch 65.

Water inlet hose 28 is a common garden hose that is connected to a common household spigot and is connected to pump 27 at its inlet via a quick connect/disconnect coupling 66. Similarly, the high pressure output of pump 27 is coupled to high pressure hose 25 via quick connect/disconnect coupling 67. This is the same type of quick connect/disconnect coupling that is provided at inlets 22 and 23 for snow gun 20.

Air compressor 26 is also electrically operated and provided with an electric switch 68 for on and off operation.

Valve 61 is a three-way valve and is shown in its normal operating position. When valve 61 is rotated to the right by 180°, all lines are connected to drain 70. This permits natural draining to the extent possible of the air lines and water lines when the system is turned off.

In order to purge all water from high pressure water line or hose 25, valve 61 is left in its normal operating position as illustrated in FIG. 7, water pump 27 is turned off, and air valve 60 is rotated 90° to the right or clockwise as illustrated in the figure so that air under pressure from air tank 50 is connected directly to high pressure water hose 25 via three-way valve 61. This will cause all the water therein to be blown out and sufficient air pressure is provided to even blow all of the water out through the nozzles 21.

Water hose 28 may also be disconnected at inlet 66 for pump 27 and in the blowout mode, water will also be blown out of pump 27.

A bottom valve 71 is also provided at the bottom of air tank 50 in order to periodically drain accumulated condensation water from within air tank 50.

Figure 8:
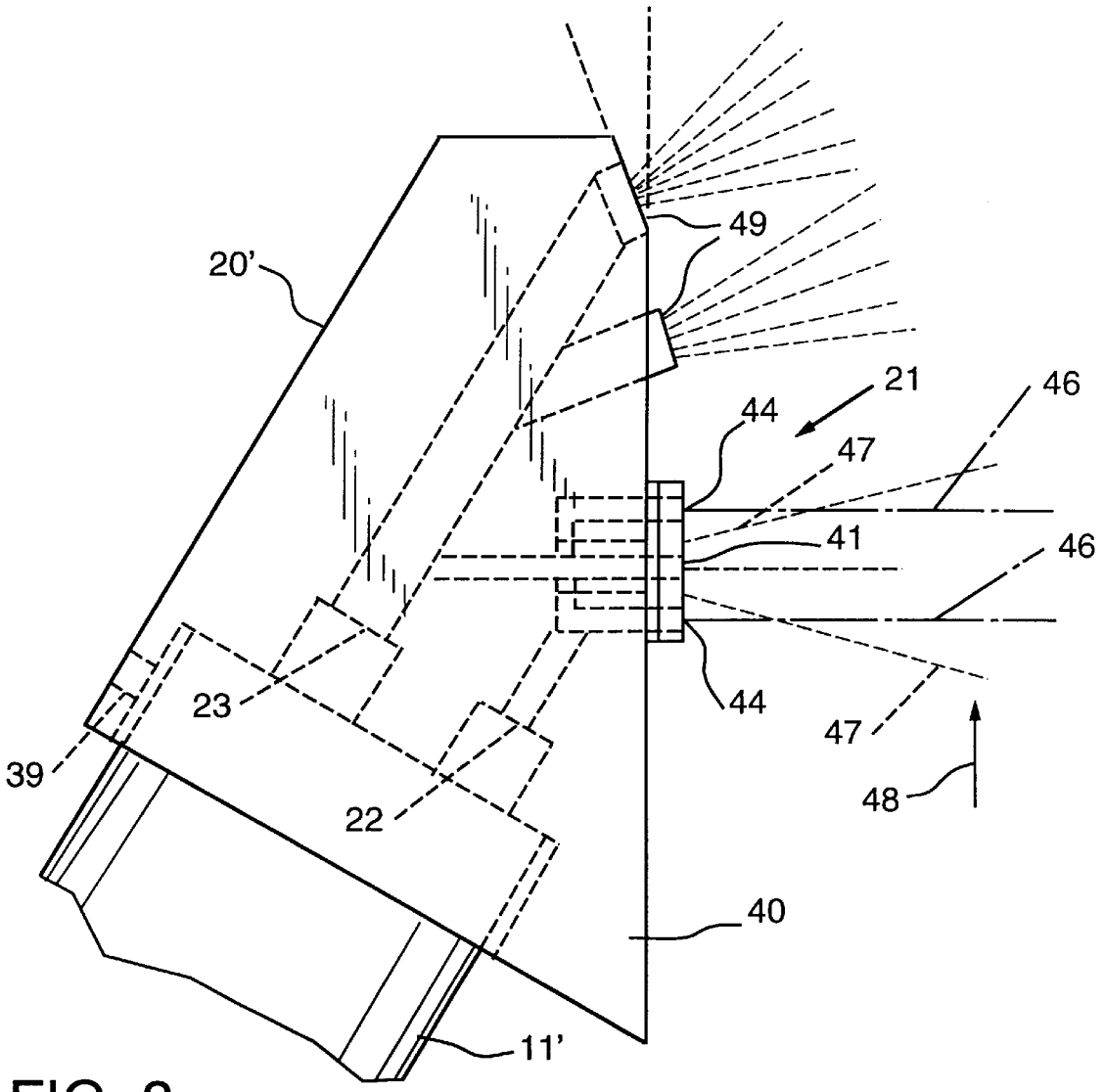
FIG. 8 is an enlarged view in side elevation illustrating another embodiment of the snow making gun for mounting on top of the support pole for the portable snow making system for home use of the present invention.

Referring next to FIG. 8, another embodiment of the snow gun mounted at the top of elongated pole 11 is illustrated here by reference numeral 20' and is substituted for the snow gun 20 illustrated in the previous embodiments.

In this embodiment, the housing 40 is provided with two spaced air nozzles 44 connected to air inlet 22 for discharging air under pressure in streams as indicated at 46 into ambient atmosphere. A first water nozzle 41 is positioned in housing 40 centrally between air nozzles 44 and is connected to the water inlet 23 for discharging water in the form of a spray 47 into ambient atmosphere. This water spray discharge is discharged into the air discharges or streams 46 thereby creating an atomized plume 48 of water.

Additional water nozzles 49 are also provided in housing 40 of snow gun 20' and are additionally connected to water inlet 23. Nozzles 49 are further positioned for discharging water under pressure into ambient atmosphere as illustrated for combining eventually with plume 48. The advantages of this type of operation is illustrated in U.S. Pat. Nos. 5,004,151 and 5,823,427.

Also, in this embodiment the telescopic pole 11 is substituted with an aluminum extruded double tube which provides two passages (not shown) therein for separately transmitting water and air under pressure to inlets 23 and 22 respectively for snow making gun 20'. Elongated passages within extrusion tube 11' are in sealed engagement respectively with inlets 23 and 22, and the upper end of extrusion 11' is held in position by means of a set screw provided at 39.

We claim:

1. A portable snow making system for home use comprising: a portable snow making tower having an elongated support pole supported from a base and having upper and lower ends with a snow making gun mounted on the upper end, snow making nozzles in said gun for discharging air and water under pressure into ambient atmosphere for making snow in subfreezing conditions, air and water inlets on said gun for respective connection to sources of air and water under pressure, a hand towable vehicle having mounted thereon a high pressure water pump and an air compressor providing respectively said sources of water and air under pressure, air and water high pressure hoses respectively connecting said sources of air and water under pressure to said air and water inlets on said gun, a hose connected to said water pump for connecting said water pump to a common water supply for supplying water to said water pump, said pole base supported on said towable vehicle, and wherein said elongated support pole is hollow and contains at least one of said high pressure hoses.

2. The portable snow making system of claim 1 wherein said elongated support pole is detachable at its lower end from a base on said towable vehicle and said pole is keyed to said base for preventing relative rotation therebetween.

3. A portable snow making system for home use comprising: a portable snow making tower having an elongated support pole having upper and lower ends with a snow making gun mounted on the upper end, snow making nozzles in said gun for discharging air and water under pressure into ambient atmosphere for making snow in subfreezing conditions, air and water inlets on said gun for respective connection to sources of air and water under pressure, a hand towable vehicle having mounted thereon a high pressure water pump and an air compressor providing respectively said sources of water and air under pressure, air and water high pressure hoses respectively connecting said sources of air and water under pressure to said air and water inlets on said gun, a hose connected to said water pump for connecting said water pump to a common water supply for supplying water to said water pump, said pole supported on said towable vehicle, and said towable vehicle comprised of an air tank for said compressor which serves as a vehicle body for said towable vehicle.

4. The portable snow making system of claim 3 including handles secured to one end of said air tank for moving said towable vehicle in wheelbarrow fashion.

5. The portable snow making system of claim 4 including vehicle wheels secured to said tank at an end thereof opposite to said one end.

6. A portable snow making system for home use comprising: a portable snow making tower having an elongated support pole having upper and lower ends with a snow making gun mounted on the upper end, snow making nozzles in said gun for discharging air and water under pressure into ambient atmosphere for making snow in subfreezing conditions, air and water inlets on said gun for respective connection to sources of air and water under pressure, a hand towable vehicle having mounted thereon a high pressure water pump and an air compressor providing respectively said sources of water and air under pressure, air and water high pressure hoses respectively connecting said sources of air and water under pressure to said air and water inlets on said gun, a hose connected to said water pump for connecting said water pump to a common water supply for supplying water to said water pump, said pole supported on said towable vehicle, and a valve mechanism connected between said air high pressure hose and said water high pressure hose for selective manipulation of said valve mechanism to purge said water high pressure hose of water with compressed air.

7. A portable snow making system for home use comprising: a portable snow making tower having an elongated support pole having upper and lower ends with a snow making gun mounted on the upper end; snow making nozzles in said gun for discharging air and water under pressure into ambient atmosphere for making snow in sub-freezing conditions, air and water inlets on said gun for respective connection to sources of air and water under pressure; a hand towable vehicle having mounted thereon a high pressure water pump and an air compressor providing respectively said sources of water and air under pressure; air and water high pressure hoses respectively connecting said sources of air and water under pressure to said air and water inlets on said gun, a hose connected to said water pump for connecting said water pump to a common water supply for supplying water to said water pump; said pole supported on said towable vehicle; and said gun including a housing having at least one air nozzle connected to said air inlet for discharging air under pressure into ambient atmosphere, a first water nozzle positioned in said housing adjacent said at least one air nozzle and connected to said water inlet for discharging water under pressure into ambient atmosphere and into said at least one air discharge for atomizing said water discharge and thereby creating an atomized plume of water, and at least one additional water nozzle in said housing and connected to said water inlet and positioned for discharging additional water under pressure into ambient atmosphere for combining with said plume.

* * * * *